US010241449B1

(12) United States Patent
Arakawa

(10) Patent No.: US 10,241,449 B1
(45) Date of Patent: Mar. 26, 2019

(54) CLEANING SHEET FOR USE IN AN IMAGE FORMING APPARATUS AND CLEANING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masaya Arakawa, Hiratsuka Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/713,910

(22) Filed: Sep. 25, 2017

(51) Int. Cl.
*G03G 15/02* (2006.01)
*G03G 15/20* (2006.01)
*G03G 15/00* (2006.01)

(52) U.S. Cl.
CPC ..... *G03G 15/2025* (2013.01); *G03G 15/0258* (2013.01); *G03G 15/2039* (2013.01); *G03G 15/2078* (2013.01); *G03G 15/50* (2013.01); *G03G 15/6529* (2013.01); *G03G 15/6588* (2013.01); *G03G 15/6591* (2013.01); *G03G 15/6594* (2013.01)

(58) Field of Classification Search
CPC ..... G03G 15/0258; G03G 15/2025; G03G 15/2039; G03G 15/2075; G03G 15/2078; G03G 15/50; G03G 15/6529; G03G 15/6588; G03G 15/6591; G03G 15/6594; G03G 2215/00308; G03G 2215/00312; G03G 2215/00476; G03G 2215/00493; G03G 2215/00523; G03G 2215/00531
See application file for complete search history.

(56) References Cited

U.S. PATENT DOCUMENTS

2002/0112300 A1* 8/2002 Muhr-Sweeney ..... B08B 1/00 15/104.002
2011/0268482 A1* 11/2011 Akamatsu ..... G03G 15/2025 399/327
2017/0205744 A1* 7/2017 Tanaka ..... G03G 15/2075

FOREIGN PATENT DOCUMENTS

JP 2008-266012 11/2008
JP 2016-87833 5/2016

* cited by examiner

*Primary Examiner* — Joseph S Wong
(74) *Attorney, Agent, or Firm* — Amin, Turocy & Watson LLP

(57) ABSTRACT

An image forming apparatus includes a transport unit, a printing unit, a fixing unit, and a control unit. The transport unit transports a first printing medium having an adhering matter and a second printing medium other than the first printing medium. The printing unit forms an image on the first printing medium. The fixing unit heats and presses the first printing medium at a fixing temperature. The control unit executes a printing operation on the first printing medium and executes a cleaning operation based on a usage amount of the first printing medium. In the printing operation, the first printing medium is transported by the transport unit, an image is formed on the first printing medium, and the first printing medium is heated and pressed by the fixing unit. In the cleaning operation, the second printing medium is transported and is passed through the fixing unit.

9 Claims, 6 Drawing Sheets

CLEANING SHEET FOR USE IN AN IMAGE FORMING APPARATUS AND CLEANING METHOD

FIELD

Embodiments described herein relate generally to an image forming apparatus and a cleaning method.

BACKGROUND

An image forming apparatus such as a multifunction peripheral (MFP), a copying machine, a printer, or a facsimile machine can also print on paper other than plain paper, or the like. Such an image forming apparatus can print on, for example, a label sheet. However, when the image forming apparatus performs printing on the label sheet or the like, adhesive used for the label sheet may adhere to a fixing device. Since the fixing device heats and presses a printing medium, it is considered that the adhesive is likely to adhere to the fixing device due to melting of the adhesive. An adhering matter adhered to the fixing device causes a defect such as paper jams or stains on a printed matter. In addition, in the related art, servicemen or the like has dealt with the defect by opening a housing to solve such a defect. Therefore, there is a problem that labor and cost are required to solve such a problem.

DETAILED DESCRIPTION

In general, according to one embodiment, an image forming apparatus includes a transport unit, a printing unit, a fixing unit, and a control unit. The transport unit transports a first printing medium having an adhering matter and a second printing medium other than the first printing medium. The printing unit forms an image on the first printing medium. The fixing unit heats and presses the first printing medium at a fixing temperature to fix the image. The control unit executes a printing operation on the first printing medium and executes a cleaning operation according to a usage amount of the first printing medium. In the printing operation, the first printing medium is transported by the transport unit, an image is formed on the first printing medium by the printing unit, and the first printing medium is heated and pressed by the fixing unit. In the cleaning operation, the second printing medium is transported by the transport unit and is passed through the fixing unit.

Hereinafter, an image forming apparatus according to some embodiments will be described with reference to the drawings.

First Embodiment

Figure 1:
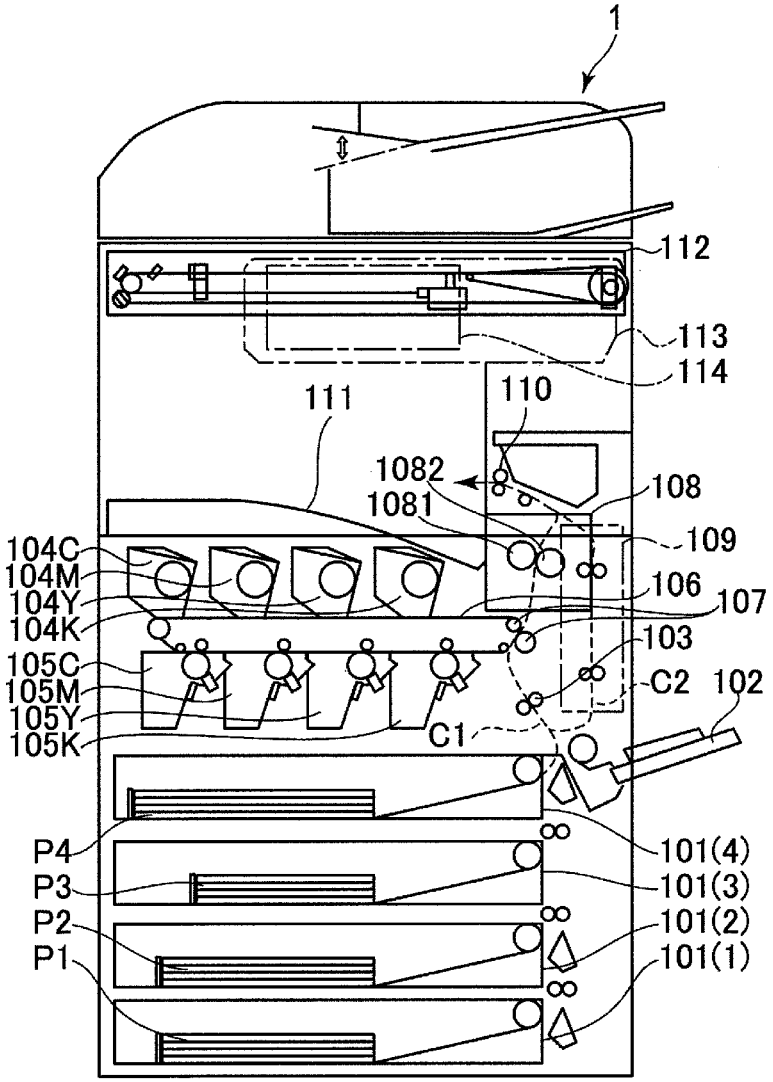
FIG. 1 is a schematic view illustrating an example of an outline of an image forming apparatus according to a first embodiment to a third embodiment.

FIG. 1 is a schematic view illustrating an example of an outline of an image forming apparatus 1 according to a first embodiment.

The image forming apparatus 1 has a printing function of forming an image on a printing medium using toner or the like. The printing medium is, for example, sheet-like paper, resin, or the like. In addition, the image forming apparatus has a scanning function of reading an image from the printing medium on which the image is formed, or the like. Furthermore, the image forming apparatus has a copy function of printing an image read from the printing medium on another printing medium. The image forming apparatus is, for example, an MFP, a copying machine, a printer, or the like. The image forming apparatus 1 includes a paper feeding cassette 101, a manual feeding tray 102, a transport roller 103, a toner cartridge 104, an image forming unit 105, a transfer belt 106, a transfer roller 107, a fixing unit 108, a double-sided unit 109, a paper discharge roller 110, a paper discharge tray 111, an image reading unit 112, and a control panel 113.

The paper feeding cassette 101 stores a printing medium such as plain paper or a label sheet. The image forming apparatus 1 includes one or a plurality of paper feeding cassettes 101. As illustrated in FIG. 1, the image forming apparatus 1 includes, for example, the paper feeding cassettes of four stages. A printing medium P1 to a printing medium P4 are respectively stored in a paper feeding cassette 101(1) of a first stage to a paper feeding cassette 101(4) of a fourth stage. Moreover, the label sheet is a printing medium where an adhering matter may adhere to the fixing unit 108. Therefore, the label sheet is an example of the first printing medium having the adhering matter.

The manual feeding tray 102 is a tray provided for manually feeding the printing medium. The manual feeding tray 102 carries the printing medium loaded on the manual feeding tray 102 in the image forming apparatus 1.

The transport roller 103 is rotated by an action of a motor to transport the printing medium.

The toner cartridge 104 stores a recording material such as toner to be supplied to the image forming unit 105. The image forming apparatus 1 includes one or a plurality of toner cartridges 104. As illustrated in FIG. 1, the image forming apparatus 1 includes, for example, four toner cartridges 104 of a toner cartridge 104C, a toner cartridge 104M, a toner cartridge 104Y, and a toner cartridge 104K. The toner cartridge 104C, the toner cartridge 104M, the toner cartridge 104Y, and the toner cartridge 104K respectively store the recording material corresponding to each color of cyan, magenta, yellow, and key (black) (CMYK). Moreover, the color of the recording material stored in the toner cartridge 104 is not limited to each color of CMYK and may be another color. In addition, the recording material stored in the toner cartridge 104 may be a special recording material. For example, the toner cartridge 104 stores a decolorable recording material which is decolorized at a temperature higher than a predetermined temperature to become an invisible state.

The image forming apparatus 1 includes one or a plurality of image forming units 105. As illustrated in FIG. 1, the image forming apparatus 1 includes, for example, four image forming units 105 of an image forming unit 105C, an image forming unit 105M, an image forming unit 105Y, and an image forming unit 105K. The image forming unit 105C, the image forming unit 105M, the image forming unit 105Y, and the image forming unit 105K respectively correspond to each color of CMYK and the recording material of the corresponding color is supplied from each toner cartridge 104.

Each of the image forming units 105 forms an image for transferring to the printing medium using the recording material of the corresponding color. Therefore, each of the image forming units 105 superimposes and transfers a formed image of each color on the transfer belt 106.

The transfer belt 106 is, for example, an endless belt and rotates to transport an image transferred on the belt to a position of the transfer roller 107 by each of the image forming units 105.

The transfer roller 107 includes two rollers facing each other. The transfer roller 107 rotates to transfer the image formed on the transfer belt 106 to the printing medium.

The fixing unit 108 heats and presses the printing medium to which an image is transferred. Therefore, the image transferred to the printing medium is fixed.

The fixing unit 108 includes a heat roller 1081 and a pressing roller 1082 facing each other. The heat roller 1081 includes a heat source such as a heater for heating the heat roller 1081. The heat roller 1081 includes a thermometer or the like, and is capable of making a temperature of a portion facing the pressing roller 1082 to a set temperature under the control of a processor 11. The heat roller 1081 heats the printing medium passing between the heat roller 1081 and the pressing roller 1082. Moreover, the temperature of the heat roller 1081 when the image transferred to the printing medium is fixed is referred to as the fixing temperature. The fixing temperature is, for example, approximately 150° C.

The pressing roller 1082 presses the printing medium passing between the heat roller 1081 and the pressing roller 1082.

The double-sided unit 109 causes the printing medium to be a state where it is possible to print on a back side. For example, the double-sided unit 109 switches back the printing medium using a roller which is rotated by the action of a motor, or the like to reverse the front and back sides of the printing medium.

The paper discharge roller 110 is rotated by the action of a motor to discharge the printing medium to the outside of the housing.

The paper discharge tray 111 is a table on which the printing medium discharged to the outside of the housing is placed by the paper discharge roller 110.

The image reading unit 112 reads an image on a document or the like. The document is, for example, a printing medium where an image or the like is formed on a surface thereof. The image reading unit 112 includes, for example, an optical reduction type scanner including an imaging device such as a charge-coupled device (CCD) image sensor. Alternatively, the image reading unit 112 includes a contact image sensor (CIS) type scanner including an imaging device such as a complementary metal-oxide-semiconductor (CMOS) image sensor. Alternatively, the image reading unit 112 includes another known type scanner.

The control panel 113 includes buttons for an operator to operate the image forming apparatus 1, a touch panel 114, and the like. The buttons and the touch panel 114 included in the control panel 113 function as an input device that accepts operations by the operator of the image forming apparatus 1. In addition, the touch panel 114 functions as a display device for notifying the operator of various types of information of the image forming apparatus 1.

Figure 2:
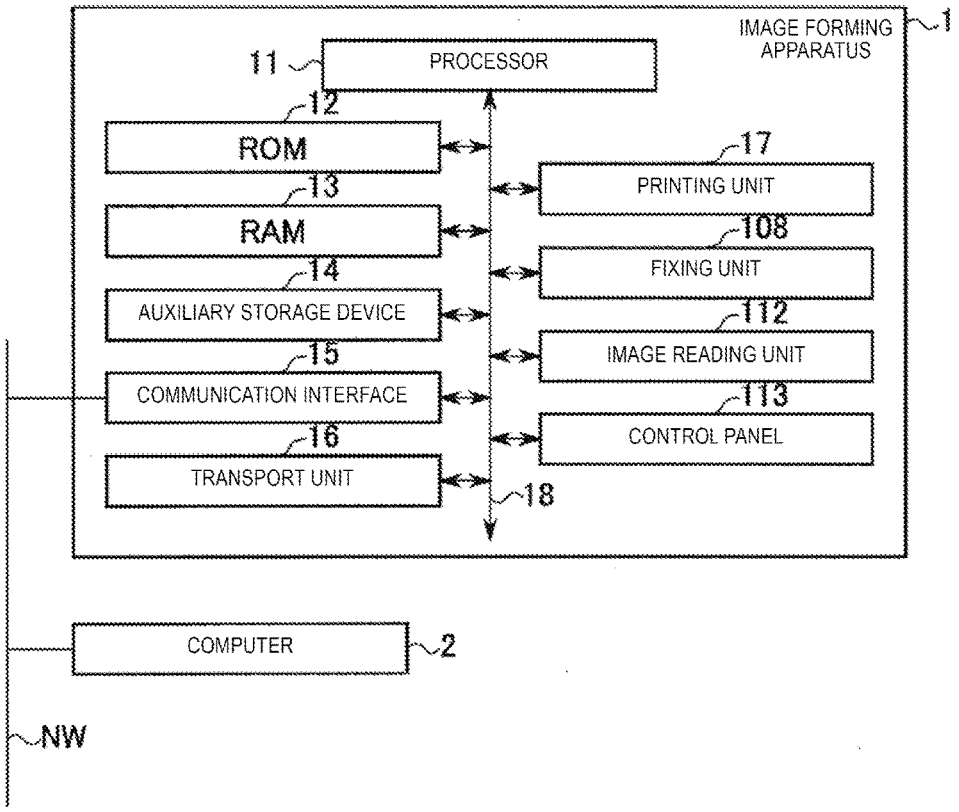
FIG. 2 is a block diagram illustrating a main circuit configuration.

FIG. 2 is a block diagram illustrating a main circuit configuration or the like of the image forming apparatus 1. As illustrated in FIG. 2, the image forming apparatus 1 includes the processor 11, a read-only memory (ROM) 12, a random-access memory (RAM) 13, an auxiliary storage device 14, a communication interface 15, a transport unit 16, a printing unit 17, a bus 18, the fixing unit 108, the image reading unit 112, and the control panel 113. The ROM 12, the RAM 13, the auxiliary storage device 14, the communication interface 15, the transport unit 16, the printing unit 17, the bus 18, the fixing unit 108, the image reading unit 112, and the control panel 113 are connected to the processor 11 by the bus 18 or the like.

The processor 11 corresponds to a central portion of a computer that performs processes such as calculation and control necessary for the operation of the image forming apparatus 1. The processor 11 controls each unit to realize various functions of the image forming apparatus 1 based on a program such as system software, application software, or firmware stored in the ROM 12, the auxiliary storage device 14, or the like. The processor 11 is, for example, a central processing unit (CPU), a micro processing unit (MPU), a system on a chip (SoC), a digital signal processor (DSP), a graphics processing unit (GPU), or the like. Alternatively, the processor 11 is a combination thereof. The processor 11 is an example of the control unit. The computer in which the processor 11 is the central portion is an example of the control unit.

The ROM 12 corresponds to a main storage device of the computer in which the processor 11 is the central portion. The ROM 12 is a nonvolatile memory used exclusively for reading data. The ROM 12 stores the above-described program. In addition, the ROM 12 stores data used for the processor 11 to perform various processes, various setting values, or the like.

The RAM 13 corresponds to the main storage device of the computer in which the processor 11 is the central portion. The RAM 13 is a memory used for reading and writing data. The RAM 13 stores data temporarily used for the processor 11 to perform various processes and is used as a so-called work area, or the like.

The auxiliary storage device 14 corresponds to an auxiliary storage device of the computer in which the processor 11 is the central portion. The auxiliary storage device 14 is, for example, an electric erasable programmable read-only memory (EEPROM), a hard disk drive (HDD), a solid state drive (SSD), or the like. The auxiliary storage device 14 may store the above-described program. In addition, the auxiliary storage device 14 stores data used for the processor 11 to perform various processes, data generated by the process in the processor 11, various setting values, or the like. Moreover, the image forming apparatus 1 may include an interface capable of inserting a storage medium such as a memory card, or a Universal Serial Bus (USB) memory instead of the auxiliary storage device 14 or in addition to the auxiliary storage device 14.

Moreover, the auxiliary storage device 14 stores a job list, a printing medium list, a printing counter, a label counter, a threshold X, and a value N. The job list is a list of unprinted printing job. The printing medium list is a list of the printing media that can be used for printing in the image forming apparatus 1. The printing counter counts a value indicating a usage amount of paper on which printing is performed by the image forming apparatus 1. The label counter counts a value indicating a usage amount of the label sheet on which printing is performed by the image forming apparatus 1. The threshold value X is a value used for determining whether or not the image forming apparatus 1 has to be cleaned. Moreover, the threshold X is a value that is set by an operator or an administrator of the image forming apparatus 1, or the like. Alternatively, the threshold X is a value that is set by a designer of the image forming apparatus 1 or the like. The value N indicates the number of the printing media to be fed in the cleaning operation. The value N is, for example, a value that is set by the operator or the administrator of the image forming apparatus 1, or the like. Alternatively, the value N is a value that is set by the designer of the image forming apparatus 1 or the like.

A program stored in the ROM 12 or the auxiliary storage device 14 includes a control program which is described with respect to the control process described later. As an example, the image forming apparatus 1 is transferred to the administrator of the image forming apparatus 1 or the like in a state where a control program is stored in the ROM 12 or the auxiliary storage device 14. However, the image forming apparatus 1 may be transferred to the administrator or the like in a state where a control program which is described with respect to the control process described later is not stored in the ROM 12 or the auxiliary storage device 14. In addition, the image forming apparatus 1 may be transferred to the administrator or the like in a state where another control program is stored in the ROM 12 or the auxiliary storage device 14. Thus, the control program described with respect to the control process described later may be separately transferred to the administrator or the like, and the control program may be written to the ROM 12 or the auxiliary storage device 14 under an operation by the administrator or a serviceman. In this case, the transfer of the control program can be realized, for example, by recording on a removable storage medium such as a magnetic disk, a magneto optical disk, an optical disk, or a semiconductor memory, or by downloading via a network.

The communication interface 15 is an interface through which the image forming apparatus 1 communicates via a network NW or the like. The image forming apparatus 1 is connected to the network NW via the communication interface 15. The network NW is typically a communication network including a local area network (LAN). In addition, the network NW is connected to a computer 2.

The computer 2 is, for example, a personal computer (PC), a server, or the like. In the computer 2, a program including a function of transmitting the printing job to the image forming apparatus 1 is installed.

The transport unit 16 controls a motor for driving the transport roller 103, the double-sided unit 109, the paper discharge roller 110, and the like for transporting the printing medium.

The printing unit 17 forms an image on the printing medium or the like to perform printing. The printing unit 17 includes the image forming unit 105, the transfer belt 106, the transfer roller 107, and the like.

The bus 18 includes a control bus, an address bus, a data bus, or the like, and transmits a signal which is received and transmitted from and to each unit of the image forming apparatus 1.

Figure 3:
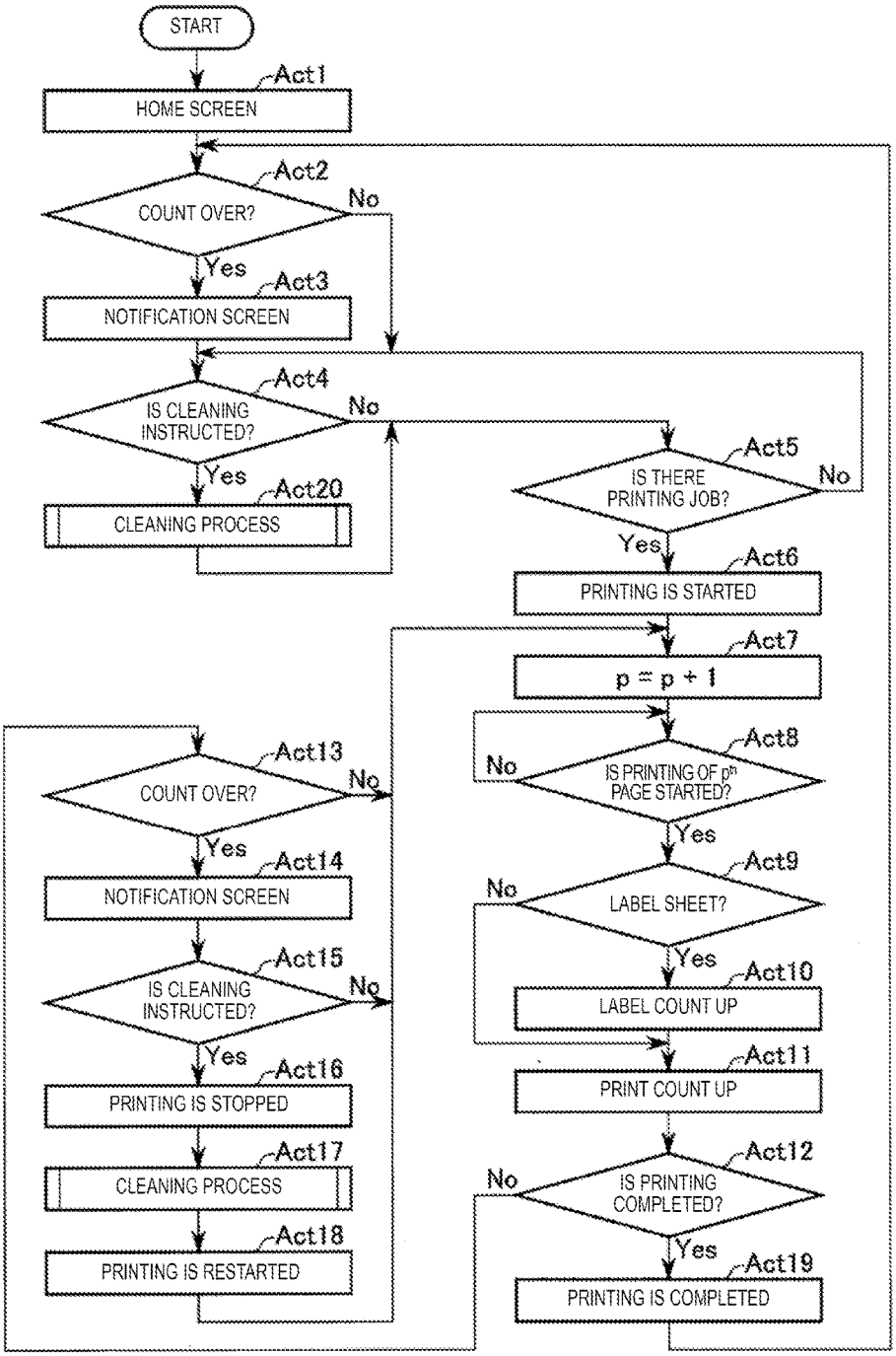
FIG. 3 is a flowchart of a control process by a processor in FIG. 2.
Figure 4:
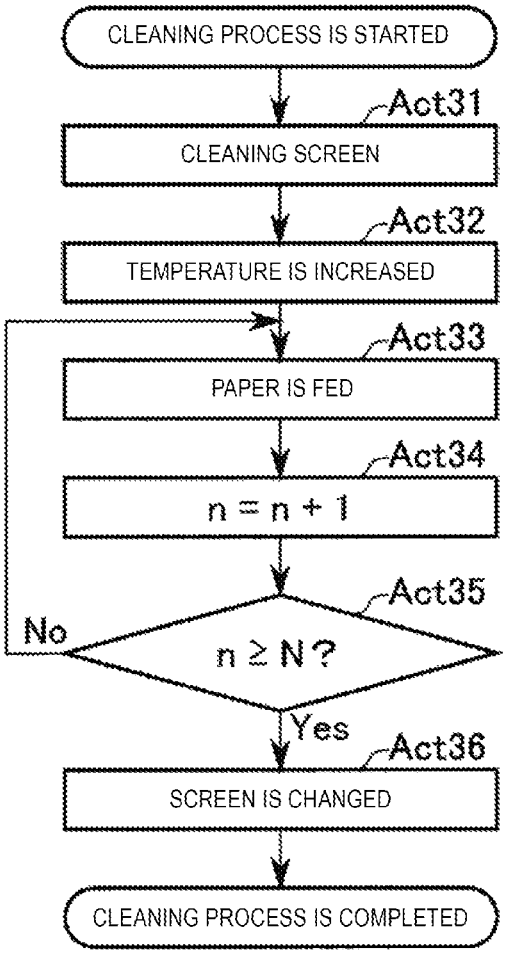
FIG. 4 is a flowchart of a control process by the processor in FIG. 2.

Hereinafter, an operation of the image forming apparatus 1 according to the embodiment will be described with reference to FIGS. 3 and 4. Moreover, a content of the process in the following operation description is an example and it is possible to appropriately use various processes capable of obtaining similar results. FIGS. 3 and 4 are flowcharts of the control process by the processor 11 of the image forming apparatus 1. The processor 11 executes the control process based on the control program stored in the ROM 12, the auxiliary storage device 14, or the like. Moreover, the processor 11 starts, for example, the control process illustrated in FIG. 3 in response to activation of the image forming apparatus 1 or in response to returning of the image forming apparatus 1 from a standby mode or the like. Moreover, when the control process illustrated in FIG. 3 is started, the processor 11 assigns a variable p to the RAM 13 or the like.

Moreover, unless otherwise specified, the processor 11 proceeds to Act (n+1) after the process of Act (n) (n is a natural number).

When printing is performed on the label sheet using the image forming apparatus 1, the user or the administrator of the image forming apparatus 1, or the like puts the label sheet in the paper feeding cassette 101 in advance. Then, the user, the administrator, or the like operates the control panel 113 and selects the label sheet from the printing medium list to input the type of the printing medium put in the paper feeding cassette 101. In addition, the user, the administrator, or the like operates the control panel 113 and inputs a size of the printing medium put in the paper feeding cassette 101. For example, when the user puts the label sheet of an A4 size in the paper feeding cassette 101(1) of the first stage, the user operates the control panel 113 to input the fact that the type of the printing medium P1 input in the paper feeding cassette 101(1) of the first stage is the label sheet. Furthermore, the user operates the control panel 113 to input the fact that the size of the printing medium P1 input in the paper feeding cassette 101(1) of the first stage is A4. The type and the size of the printing medium input in the paper feeding cassette 101(1) are input into the image forming apparatus 1 based on the above-described operation. The processor 11 stores the type and the size of the input printing medium in the auxiliary storage device 14 or the like in association with the paper feeding cassette 101(1). In addition, the user, the administrator, or the like performs the same operation as the above-described operation or the like in addition to the label sheet. Therefore, the type of the printing medium housed in the plurality of paper feeding cassettes 101 respectively is stored in the auxiliary storage device 14 or the like.

Alternatively, the user, the administrator, or the like operates the computer 2 instead of operating the control panel 113. That is, the user, the administrator, or the like puts the printing medium such as the label sheet in the paper feeding cassette 101 and then operates the computer 2 to select the printing medium put in the paper feeding cassette 101 from the printing medium list. Moreover, the computer 2 acquires the printing medium list from the image forming apparatus 1 or the like. Furthermore, the user, the administrator, or the like operates the computer 2 to input the size of the printing medium put in the paper feeding cassette 101. The computer 2 transmits a command including the type and the size of the selected printing medium to the image forming apparatus 1 based on the operation. The command is received by the communication interface 15 of the image forming apparatus 1. The command is received and thereby the type and the size of the printing medium put in the paper feeding cassette 101 are input into the image forming apparatus 1. The processor 11 stores the type and the size of the input printing medium in the auxiliary storage device 14 in association with the paper feeding cassette 101.

Thereafter, the user of the image forming apparatus 1 operates the control panel 113 or the computer 2 to select the paper feeding cassette 101 used for printing when printing is performed. For example, the user selects the paper feeding cassette 101 in which the label sheet is put when printing is performed on the label sheet. The processor 11 registers the printing job relating to the printing in the job list based on the above-described operation.

In addition, the user of the image forming apparatus 1 may use the manual feeding tray 102 instead of the paper feeding cassette 101. That is, the user places the label sheet on the manual feeding tray 102. The user operates the control panel 113 and selects the label sheet from the printing medium list to input the type of the printing medium placed on the manual feeding tray 102. In addition, the user operates the control panel 113 to input the size of the label sheet placed on the manual feeding tray 102. Alternatively, the user of the image forming apparatus 1 may also input the type and the size of the printing medium placed on the manual feeding tray 102 into the image forming apparatus 1 by operating the computer 2 similar to when the label sheet is put in the paper feeding cassette 101. The type and the size of the printing medium placed on the manual feeding tray 102 are input into the image forming apparatus 1 based on the above-described operation. Furthermore, the user performs instructions of printing. The processor 11 registers the printing job relating to the printing in the job list based on the above-described operation.

In Act 1 of FIG. 3, the processor 11 of the image forming apparatus 1 generates an image corresponding to a home screen. The processor 11 instructs the touch panel 114 to display the generated image. The touch panel 114 which receives the instruction displays the home screen. The home screen includes, for example, buttons operated by the operator of the image forming apparatus 1 to execute various functions.

In Act 2, the processor 11 of the image forming apparatus 1 determines whether or not a value of the label counter is a threshold X or more. When the value of the label counter is less than the threshold X, the processor 11 determines No in Act 2 and proceeds to Act 4. Meanwhile, when the value of the label counter is the threshold X or more, the processor 11 determines Yes in Act 2 and proceeds to Act 3.

In Act 3, the processor 11 starts displaying a notification screen. Moreover, the notification screen will be described below.

In Act 4, the processor 11 determines whether or not start of cleaning is instructed. When the start of cleaning is not instructed, the processor 11 determines No in Act 4 and proceeds to Act 5. Moreover, the instruction of the start of cleaning will be described below.

In Act 5, the processor 11 determines whether or not there is the printing job in the job list. When there is no printing job in the job list, the processor 11 determines No in Act 5 and returns to Act 4. Thus, the processor 11 repeats Act 4 and Act 5 until it is determined that there is an instruction to perform cleaning or there is the printing job in the job list.

When it is determined that there is the printing job in the job list while in a standby state of Act 4 and Act 5, the processor 11 determines Yes in Act 5 and proceeds to Act 6.

In Act 6, the processor 11 determines the printing job in which printing is performed. Usually, the CPU determines the first registered printing job among the printing jobs registered in the job list as a printing job to be printed. The processor 11 controls the transport unit 16, the printing unit 17, the fixing unit 108, and the like to start printing relating to the printing job. Moreover, in this case, the processor 11 initializes the value of the variable p. That is, the processor 11 sets the value of the variable p to 0.

Printing is performed, for example, as follows. The printing medium is transported from the paper feeding cassette 101 designated by the printing job to the transfer roller 107 by the transport unit 16. The printing medium passes between the transfer rollers 107. In this case, if it is not blank printing, an image is transferred to the printing medium from the transfer roller 107. Therefore, the image is formed on the printing medium. Furthermore, the printing medium is transported to the fixing unit 108 by the transport unit 16. The printing medium is passed through the fixing unit 108, that is, between the heat roller 1081 and the pressing roller 1082. Therefore, the image formed on the printing medium is fixed. Thereafter, the printing medium is discharged to the paper discharge tray 111 or the like by the transport unit 16. The above-described operation is an example of the printing operation.

In Act 7, the processor 11 increases the value of the variable p by one.

In Act 8, the processor 11 waits for the start of printing of a $p^{th}$ page. When printing of the $p^{th}$ page is started, the processor 11 determines Yes in Act 8 and proceeds to Act 9.

In Act 9, the processor 11 determines whether or not printing of the $p^{th}$ page is performed on the label sheet. Moreover, the processor 11 determines, for example, whether or not printing is performed on the label sheet with reference to the printing job currently being printed. When printing of the $p^{th}$ page is not performed on the label sheet, the processor 11 determines No in Act 9 and proceeds to Act 11. Meanwhile, when printing of the $p^{th}$ page is performed on the label sheet, the processor 11 determines Yes in Act 9 and proceeds to Act 10.

In Act 10, the processor 11 increases the value of the label counter by one.

In Act 11, the processor 11 increases a value of a printing counter by one. Thus, the processor 11 increases the value of the label counter and each value of the printing counter for each page by one by performing the operations of Act 9 to Act 11 when printing is performed on the label sheet. When printing is performed on a sheet other than the label sheet, the processor 11 increases the value of the printing counter by one for each page. Moreover, in this case, the processor 11 increases the value of the label counter and the value of the printing counter even in blank printing that does not use toner.

In Act 12, the processor 11 determines whether or not printing is completed on the page currently being printed. That is, the processor 11 determines whether or not the $p^{th}$ page is the final page of the printing job currently being printed. When printing is not completed on the page currently being printed, the processor 11 determines No in Act 12 and proceeds to Act 13.

In Act 13, the processor 11 determines whether or not the value of the label counter is the threshold X or more. When the value of the label counter is less than the threshold X, the processor 11 determines No in Act 13 and returns to Act 7. Meanwhile, when the value of the label counter is the threshold X or more, the processor 11 determines Yes in Act 13 and proceeds to Act 14.

In Act 14, the processor 11 starts the display of the notification screen. That is, the processor 11 generates the image corresponding to the notification screen. The processor 11 instructs the touch panel 114 to display the generated image. The touch panel 114 which receives the instruction displays the notification screen.

The notification screen includes, for example, a string and a start button.

The string displayed on the notification screen includes, for example, a string indicating the fact that cleaning is required such as "adhesive used for the label sheet may adhere to the fixing unit". The string displayed on the notification screen includes, for example, a string that asks whether or not cleaning is performed such as "is cleaning started?". The string displayed on the notification screen includes, for example, a string for explaining a cleaning time such as "it takes approximately XX minutes for cleaning". The string displayed on the notification screen includes, for example, a string for explaining the fact that printing fee is not charged during cleaning such as "there is no printing fee during cleaning".

The start button is a button to be operated by the operator of the image forming apparatus 1 when the start of cleaning is instructed to the image forming apparatus 1. In the start button, for example, a string indicating that it is a button for instructing the start of cleaning such as "cleaning is started" is displayed.

Moreover, in the image forming apparatus 1, the same screen as the notification screen may also be displayed on a display device included in the computer 2. In this case, the processor 11 instructs the communication interface 15 to transmit, for example, a notification command to the computer 2. The notification command includes data or the like necessary for causing the computer 2 to display the same screen as the notification screen. When receiving the instruction, the communication interface 15 transmits the notification command to the computer 2. The transmitted notification command is received by the computer 2. The computer 2 which receives the notification command displays the same screen as the notification screen. Moreover, when the start button is operated in the computer 2, the computer 2 transmits, for example, a command indicating that the start button is operated to the image forming apparatus 1. When the command is received, the image forming apparatus 1 performs the same operation as when the start button displayed on the notification screen is operated.

In Act 15, the processor 11 determines whether or not the start of cleaning is instructed. That is, the processor 11 determines whether or not an operation which is set in advance such as the operation of the start button is performed. When the start of cleaning is not instructed, the processor 11 determines No in Act 15 and returns to Act 7. Meanwhile, when the start of cleaning is instructed, the processor 11 determines Yes in Act 15 and proceeds to Act 16.

In Act 16, the processor 11 stops printing when printing of the page currently being printed is completed. The processor 11 proceeds to Act 17 after Act 16.

In Act 17, the processor 11 starts a cleaning process illustrated in FIG. 4. That is, the image forming apparatus 1 starts the cleaning operation. Moreover, the processor 11 assigns a variable n of an initial value 1 to the RAM 13 or the like when starting the control process illustrated in FIG. 4.

In Act 31 of FIG. 4, the processor 11 generates an image corresponding to a cleaning screen. The processor 11 instructs the touch panel 114 to display the generated image. The touch panel 114 which receives the instruction displays the cleaning screen. The cleaning screen includes a string indicating that cleaning is performed currently and a stop button. The stop button is a button for the operator of the image forming apparatus 1 to operate when the stop of cleaning is instructed to the image forming apparatus 1. When the stop button is operated, the processor stops, for example, the control process illustrated in FIG. 4 and proceeds to Act 18 of FIG. 3.

In Act 32, the processor 11 controls the fixing unit 108 to change the temperature of the heat roller 1081 to a temperature higher than the fixing temperature. When receiving the instruction, the fixing unit 108 sets the temperature. Moreover, the temperature of the heat roller 1081 after the change is, for example, the fixing temperature plus several tens® C. The temperature of the heat roller 1081 which is changed by the process of Act 32 is an example of the cleaning temperature.

In Act 33, the processor 11 controls the transport unit 16 or the like to feed one printing medium from the paper feeding cassette 101. Here, the fed printing medium is a printing medium such as plain paper in which the adhering matter capable of adhering to the fixing unit 108 is not used. The printing medium may be any of coated paper, fine coated paper, and non-coated paper. Further, the printing medium may be colored paper or other special paper. Moreover, the adhering matter is, for example, an adhesive as used for the label sheet. Further, the processor 11 controls the transport unit 16, the fixing unit 108, and the like to cause the printing medium to be passed through the fixing unit 108 and further discharge to the paper discharge tray 111. The printing medium is passed through the fixing unit and thereby the adhering matter adhered to the fixing unit is adhered to the second printing medium and removed from the fixing unit. Therefore, the printing medium fed in Act 33 is an example of the second printing medium.

In Act 34, the processor 11 increases the value of the variable n by one.

In Act 35, the processor 11 determines whether or not the value of the variable n is the value N or more. When the value of the variable n is less than the value N, the processor 11 determines No in Act 35 and proceeds to Act 33. Thus, the processor 11 causes N sheets of paper to be passed through the fixing unit 108 by repeating the processes of Act 33 to Act 35.

When the value of the variable n is the value N or more, the processor 11 determines Yes in Act 35 and proceeds to Act 36.

In Act 36, the processor 11 changes the screen display to display a screen or the like before the notification screen is displayed. After Act 36, the processor 11 completes the cleaning process illustrated in FIG. 4 and proceeds to Act 18.

In Act 18, the processor 11 restarts printing which is stopped in Act 16. After Act 18, the processor 11 returns to Act 7. Thus, the processor 11 performs printing included in the printing job determined in Act 6 by repeating the processes of Act 7 to Act 18.

When printing is completed on the page currently being printed, the processor 11 determines Yes in Act 12 and proceeds to Act 19.

In Act 19, the processor 11 waits until printing of the page currently being printed is completed and performs control for completing printing. In addition, in this case, the processor 11 deletes the printing job determined in Act 6 from the job list. After Act 19, the processor 11 returns to Act 2.

In addition, when the start of cleaning is instructed in the standby state of Act 4 and Act 5, the processor 11 determines Yes in Act 4 and proceeds to Act 18.

In Act 20, the processor 11 starts the cleaning process illustrated in FIG. 4. After Act 20, the processor 11 proceeds to Act 5. From the above, the computer, in which the processor 11 is the central portion, operates as the control unit for controlling so as to perform the cleaning operation in response to the usage amount of the first printing medium by performing the processes of Act 2 and Act 20.

The image forming apparatus 1 of the first embodiment causes the printing medium on which an image is not formed to transport to the fixing unit and to be passed through the fixing unit when the usage amount of the label sheet is a certain amount or more. Therefore, the adhering matter adhered to the fixing unit 108 is removed. Specifically, the adhering matter adhered to the heat roller 1081 and the pressing roller 1082 is removed. Therefore, an incidence of defects such as paper jams or stains on the printed matter is reduced. Therefore, the number of times the serviceman deals with defects is also reduced. Thus, a labor required for the user of the image forming apparatus 1 to call a serviceman to deal with defects is reduced. In addition, the cost of the serviceman is also reduced.

In addition, in the image forming apparatus 1 of the first embodiment, a mechanism dedicated for cleaning is unnecessary so that cleaning can be performed in a simpler manner than that in the past.

In addition, the image forming apparatus 1 of the first embodiment causes the temperature of the heat roller 1081 to be a temperature higher than the fixing temperature. At a high temperature, the adhering matter adhered to the fixing unit 108 is easily melted. Therefore, the adhering matter adhered to the fixing unit 108 is easily removed.

In addition, the image forming apparatus 1 of the first embodiment causes the value of the printing counter indicating the number of printed sheets not to be increased during the cleaning operation. In a case of lease contract or the like, the image forming apparatus 1 may be charged depending on the number of printed sheets. If the image forming apparatus 1 increases the value of the printing counter even during the cleaning operation, there is a concern that the user of the image forming apparatus 1 does not execute cleaning in order to reduce the charging cost. In this case, an incidence of defects of the image forming apparatus 1 may be increased. As a defect occurs, since it is necessary for the serviceman to deal with it, the cost is required. Therefore, in the image forming apparatus 1, a failure rate of the image forming apparatus 1 can be reduced by not increasing the value of the printing counter. Therefore, the image forming apparatus 1 causes the cost of the serviceman to be reduced.

Second Embodiment

Since a configuration of an image forming apparatus 1 of a second embodiment is the same as that of the image forming apparatus 1 of the first embodiment, the description will be omitted. However, an auxiliary storage device 14 stores a value M instead of the value N. The value M indicates the number of times the printing medium is fed in the cleaning operation. For example, value M is a value set by an operator or an administrator of the image forming apparatus 1 or the like. Alternatively, the value M is a value set by a designer of the image forming apparatus 1 or the like.

Figure 5:
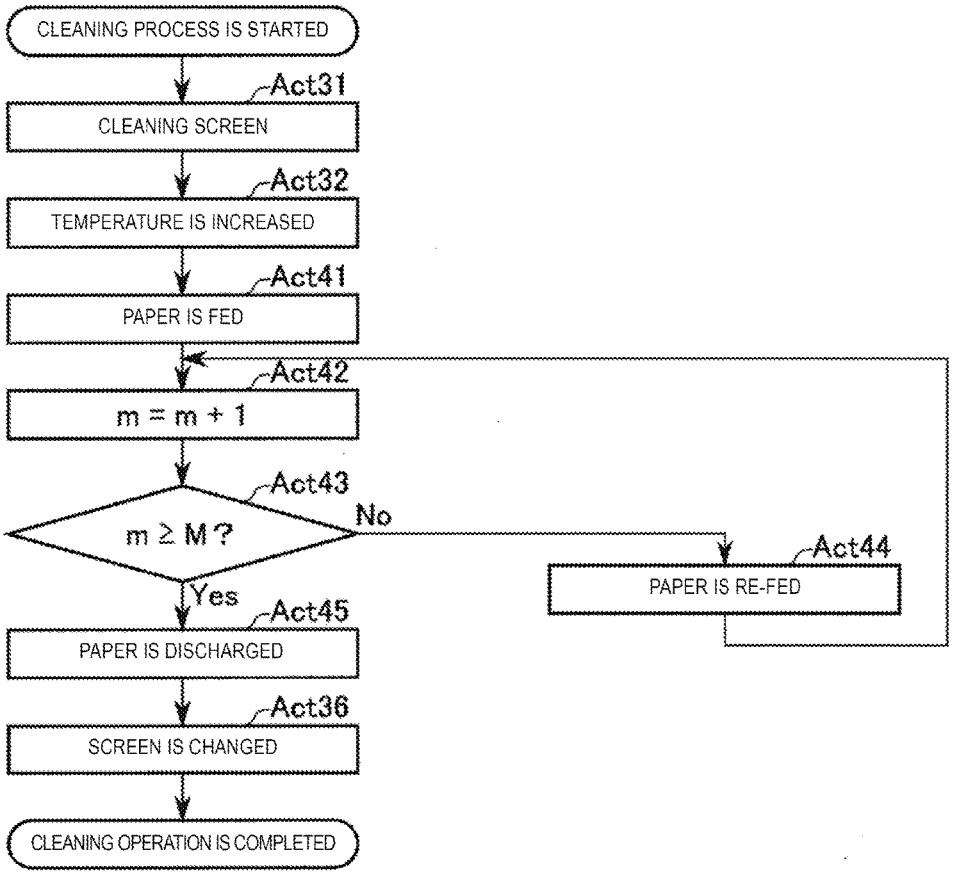
FIG. 5 is a flowchart of a control process by the processor in FIG. 2.

Hereinafter, an operation of the image forming apparatus 1 according to the second embodiment will be described with reference to FIGS. 3 and 5. Moreover, a content of the process in the following operation description is an example and it is possible to appropriately use various processes capable of obtaining similar results. FIG. 5 is a flowchart of the control process by a processor 11 of the image forming apparatus 1. The processor 11 executes the control process based on a control program stored in a ROM 12, an auxiliary storage device 14, or the like. Moreover, the same reference numerals as in FIG. 4 are given to FIG. 5 for the same process as in FIG. 4. In addition, in the second embodiment, the description of the same process as in the first embodiment may be omitted.

The processor 11 of the second embodiment performs the control process illustrated in FIG. 3 in the same manner as in the first embodiment. However, in Act 17 and in Act 20, the processor 11 performs the control process illustrated in FIG. 5 instead of the control process illustrated in FIG. 4. Moreover, the processor 11 assigns a variable m of an initial value 1 to the RAM 13 or the like when starting the control process illustrated in FIG. 5.

In the second embodiment, after Act 32 of FIG. 5, the processor 11 proceeds to Act 41.

In Act 41, the processor 11 controls a transport unit 16 and feeds the printing medium from a paper feeding cassette 101 by one. Here, the printing medium to be fed is plain paper or the like similar to in Act 33. Furthermore, the processor 11 controls the transport unit 16, the fixing unit 108, o cause the printing medium to be passed through the fixing unit 108. In Act 41, the fed printing medium is an example of the second printing medium.

In Act 42, the processor 11 increases the value of the variable m by one.

In Act 43, the processor 11 determines whether or not the value of the variable m is the value M or more. When the value of the variable m is less than the value M, the processor 11 determines No in Act 43 and proceeds to Act 44.

In Act 44, the processor 11 re-feeds the printing medium fed in Act 41. That is, the processor 11 controls the transport unit 16, a double-sided unit 109, or the like to reverse the front and back sides of the printing medium. Furthermore, the processor 11 controls the transport unit 16, the fixing unit 108, or the like to cause the printing medium to be passed through the fixing unit 108. After Act 44, the processor 11 returns to Act 42. Thus, the processor 11 causes one sheet of paper to be passed through the fixing unit 108 M times while reversing the front and back sides thereof by repeating the processes of Act 42 to Act 44.

When the value of the variable m is the value M or more, the processor 11 determines Yes in Act 43 and proceeds to Act 45.

In Act 45, the processor 11 controls the transport unit 16 to discharge fed paper in Act 41 to the paper discharge tray 111. After Act 45, the processor 11 proceeds to Act 36. After process of Act 36, the processor 11 completes the cleaning process illustrated in FIG. 5.

According to the image forming apparatus 1 of the second embodiment, the same effects as those of the image forming apparatus 1 of the first embodiment are obtained.

Furthermore, the image forming apparatus 1 of the second embodiment causes the same paper to be fed many times by using the double-sided unit 109. Therefore, the image forming apparatus 1 can reduce the amount of the printing medium consumed by the cleaning operation.

Third Embodiment

Since a configuration of an image forming apparatus 1 of a third embodiment is the same as that of the image forming apparatus 1 of the first embodiment and the second embodiment, the description will be omitted. However, an auxiliary storage device 14 stores a value M in addition to a value N. In the third embodiment, the value M indicates the number of times of feeding of one sheet of the printing medium in the cleaning operation. The value N and the value M are, for example, values set by the operator or the administrator of the image forming apparatus 1 or the like. Alternatively, the value N and the value M are values set by the designer of the image forming apparatus 1.

Figure 6:
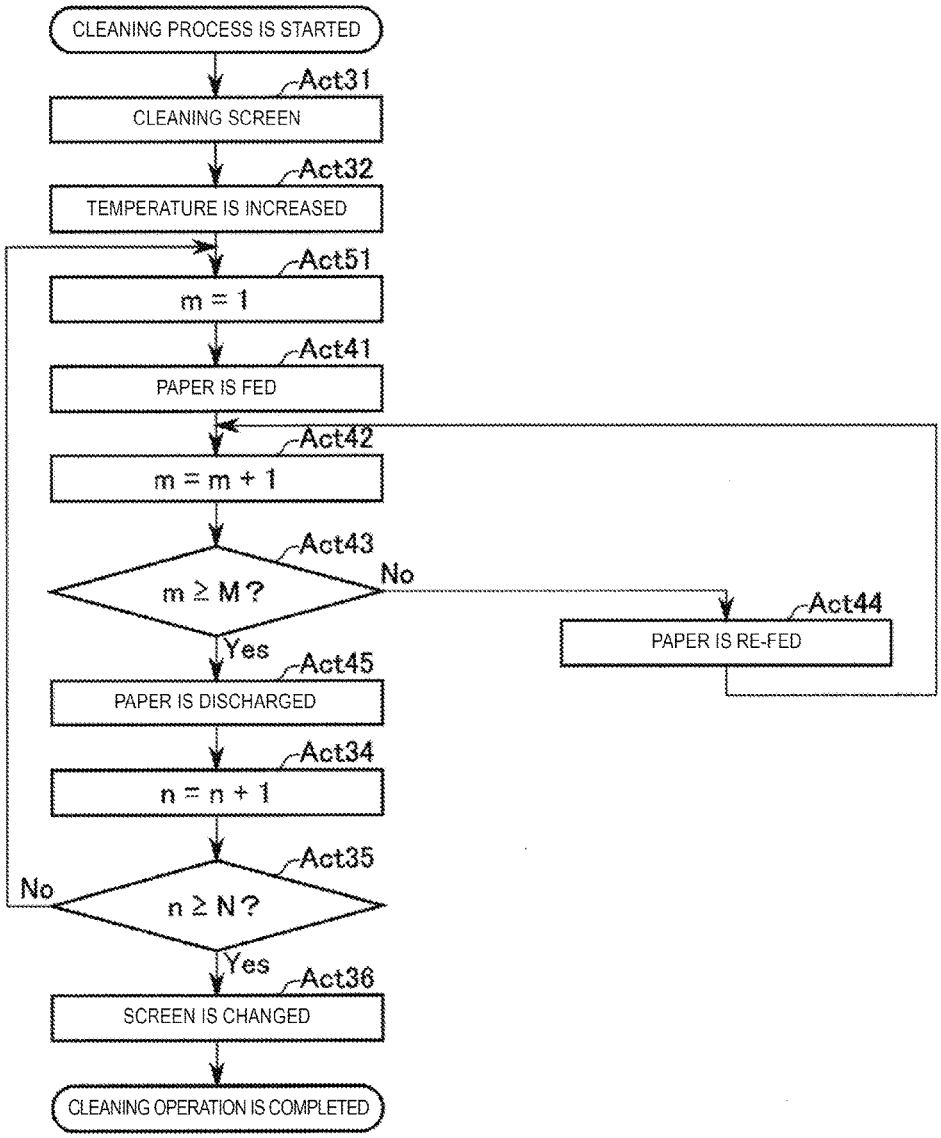
FIG. 6 is a flowchart of a control process by the processor in FIG. 2.

Hereinafter, an operation of the image forming apparatus 1 according to the third embodiment will be described with reference to FIGS. 3 and 6. Moreover, a content of the process in the following operation description is an example and it is possible to appropriately use various processes capable of obtaining similar results. FIG. 6 is a flowchart of the control process by a processor 11 of the image forming apparatus 1. The processor 11 executes the control process based on a control program stored in a ROM 12, an auxiliary storage device 14, or the like. Moreover, the same reference numerals as in FIG. 4 or 5 are given to FIG. 6 for the same process as in FIG. 4 or 5. In addition, in the third embodiment, the description of the same process as in the first embodiment or the second embodiment may be omitted.

The processor 11 of the third embodiment performs the control process illustrated in FIG. 3 in the same manner as in the first embodiment. However, in Act 17 and in Act 20, the processor 11 performs the control process illustrated in FIG. 6 instead of the control process illustrated in FIG. 4. Moreover, the processor 11 assigns the variable n and a variable m of an initial value 1 to the RAM 13 when starting the control process illustrated in FIG. 6.

In the third embodiment, after Act 32 of FIG. 6, the processor 11 proceeds to Act 51.

In Act 51, the processor 11 causes the value of the variable m to be one. After Act 51, the processor 11 proceeds to Act 41.

In the third embodiment, after the processes of Act 41 to Act 45, the processor 11 proceeds to Act 34. After the processes of Act 34 to Act 36, the processor 11 completes the cleaning process illustrated in FIG. 6.

According to the image forming apparatus 1 of the third embodiment, the same effects as those of the image forming apparatus 1 of the first embodiment and the second embodiment are obtained.

In the image forming apparatus 1 of the third embodiment, N sheets of the printing media are fed M times at a time. When only one sheet of the printing medium is passed through many times, it is considered that the efficiency of cleaning decreases for each time when the printing medium is passed through. Therefore, when one sheet of the printing medium is fed a plurality of times, in order to obtain the same cleaning effect when a plurality of sheets of the printing media are fed by one time, it may take time for cleaning as compared to when the plurality of sheets of the printing media are fed by one time. On the other hand, the next printing medium can be fed before the efficiency of cleaning decreases by causing N sheets of the printing media to be fed M times. Therefore, in the image forming apparatus 1 of the third embodiment, it is possible to prevent an increase in the cleaning time while reducing a usage amount of the printing medium for cleaning.

The above-described embodiment can also be modified as follows.

When the value of the label counter is the threshold X or more, the image forming apparatus 1 may temporarily stop an operation such as printing. In this case, the image forming apparatus 1 is, for example, as follows.

The notification screen includes a completion button in addition to the configuration elements in the above-described embodiment. The completion button is a button operated by the operator of the image forming apparatus 1 when instructing the image forming apparatus 1 not to perform cleaning. After Act 14, the processor 11 performs the process of Act 16. After Act 16, the processor 11 waits for the start button or the completion button to be operated. When the start button is operated, the processor 11 proceeds to Act 17. On the other hand, when the completion button is operated, the processor 11 proceeds to Act 18. Moreover, when the completion button is operated, the processor 11 may skip the processes of Act 13 to Act 18 until the next process of Act 6 is performed and may proceed to Act 7. In addition, in this case, when the processor 11 performs skipping of a predetermined number of times, the processes of Act 13 to Act 18 may not be skipped until the next completion button is operated. In addition, when the processor 11 determines No in Act 2, the processor 11 proceeds to Act 5. After the process of Act 3, the processor 11 waits for the start button or the completion button to be operated. When the start button is operated, the processor 11 proceeds to Act 20. On the other hand, when the completion button is operated, the processor 11 proceeds to Act 5. When the processor 11 determines No in Act 5, the processor 11 repeats Act 5.

When the value of the label counter is the threshold X or more, the image forming apparatus 1 temporarily stops printing and thereby it is possible to prevent printing from being performed without cleaning. In addition, the image forming apparatus 1 is easily noticed that the image forming apparatus 1 requires cleaning by temporarily stopping printing to the user.

When the value of the label counter is the threshold X or more, the image forming apparatus 1 may automatically start the cleaning operation. That is, for example, when the processor 11 determines Yes in the process of Act 13, the processor 11 proceeds to Act 16. Furthermore, when the processor 11 determines Yes in the process of Act 2, the processor 11 proceeds to Act 20. In addition, when the processor 11 determines No in Act 5, the processor 11 repeats Act 5. By doing as described above, the adhering matter to the fixing unit 108 is removed automatically and periodically.

In addition, when the value of the label counter is the threshold X or more, and the printing job does not exist in the job list, the image forming apparatus 1 may start the cleaning operation automatically. By doing as described above, the image forming apparatus 1 can perform cleaning while the image forming apparatus 1 is not in use.

The image forming apparatus 1 may increase the amount by which the value of the label counter is increased as the size of the label sheet is increased. It is considered that the amount of the adhesive to be adhered is increased as the size of the label sheet is increased. Therefore, by doing as described above, it is considered that the image forming apparatus 1 can perform the cleaning operation at further appropriate timing compared to when an increase amount in the label counter is fixed irrespective of the size. Moreover, the amount by which the value of the label counter is increased is not limited to an integer.

Even when printing is performed on a printing medium having the adhering matter other than the label sheet, the image forming apparatus 1 may also increase the value of the label counter. In addition, in this case, the image forming apparatus 1 may increase a value for increasing the value of the label counter as the printing medium which has a large amount of the adhering matter to be adhered depending on the type of the printing medium. The printing medium having the adhering matter is, for example, backing paper, copying paper, where an image is already formed by toner, ink, on the front surface of the sheet. The printing medium such as backing paper or copying paper of which the adhering matter may adhere to the fixing unit 108 is an example of the first printing medium. In the case of backing paper, ink, toner, or the like used for the backing paper is the adhering matter adhered to the fixing unit 108. This is because the melting temperature varies depending on the type of ink or toner. Particularly, in a case of backing paper using toner made by another company, heating may be performed at the fixing temperature in the fixing unit 108 and the toner may be melt. If toner melts, the toner may adhere to the fixing unit 108. In addition, in a case of copying paper, a material used for copying used in copying paper is the adhering matter adhered to the fixing unit 108.

Moreover, in this case, the printing medium list includes backing paper, copying paper. The user of the image forming apparatus 1 selects backing paper, copying paper, as the type of the printing medium put in the paper feeding tray when backing paper, copying paper, or the like is put in the paper feeding tray. The processor 11 determines a value for increasing the value of the label counter depending on the type of the printing medium selected from the printing medium list. The value for increasing thereof is determined in advance by the designer of the image forming apparatus 1 depending on the type of the printing medium. Alternatively, when printing is performed on the printing medium having the adhering matter that may adhere to the fixing unit 108, the value for increasing the value of the label counter by the processor 11 may be uniform regardless of the type of paper such as the label sheet, backing paper, or copying paper.

The image forming apparatus 1 may change the value for increasing the value of the label counter depending on the type of the label sheet. Moreover, in this case, the printing medium list includes a plurality of types of the label sheets. The user of the image forming apparatus 1 or the like selects the type of the label sheet put in the paper feeding tray from the plurality of types of the label sheets as the type of the printing medium put in the paper feeding tray when the label sheet is put in the paper feeding tray. In addition, in this case, the value for increasing thereof is set in advance by the designer of the image forming apparatus 1 or the like depending on the type of the label sheet. Even if it is mentioned as the label sheet, it is considered that the amount of adhesion of the adhesive to the fixing unit 108 varies depending on the use or the manufacturing company. Therefore, by doing as described above, it is considered that the image forming apparatus 1 can perform the cleaning operation at a further appropriate time compared to when an increase amount in the value of the label counter is constant irrespective of the type of the label sheet.

The image forming apparatus 1 may change the speed of paper fed from a normal speed in the cleaning operation. It is considered that the adhering matter which is difficult to be removed during normal printing is also removed by paper which is fed at a speed different from the normal speed. In addition, the image forming apparatus 1 may perform the cleaning operation while variously changing the speed of paper which is fed. By doing as described above, it is considered that the adhering matter is more likely to be removed.

The image forming apparatus 1 may cause the pressing force by the pressing roller 1082 to be different from a normal pressing force in the cleaning operation. It is considered that the adhering matter which is difficult to be removed during normal printing is also removed by paper which is fed at a pressure different from the normal pressure. In addition, the image forming apparatus 1 may perform the cleaning operation while variously changing the pressing force. By doing as described above, it is considered that the adhering matter is more likely to be removed.

The image forming apparatus 1 may perform the cleaning operation while variously changing the temperature of the heat roller 1081. Since the melting temperature varies depending on the adhering matter, by doing as described above, it is considered that the adhering matter is likely to be removed.

The image forming apparatus 1 of the first embodiment or the third embodiment may use the plurality of types of the printing media having different sizes in the cleaning operation. The adhering matter to be removed may vary depending on the size of the printing medium. Therefore, by doing as described above, it is considered that the adhering matter is likely to be removed.

The image forming apparatus 1 of the first embodiment or the third embodiment may use the plurality of types of the printing media having different paper quality or the like in the cleaning operation. The adhering matter to be removed may vary depending on the paper quality. Therefore, by doing as described above, it is considered that the adhering matter is likely to be removed.

The image forming apparatus 1 may perform the cleaning operation using the printing medium placed on the manual feeding tray. Therefore, even when only a printing medium that cannot be used for cleaning is put in the paper feeding cassette 101, the user does not need to open the paper feeding cassette 101 and does not replace the printing medium put therein. Therefore, the labor of the user is reduced.

The image forming apparatus 1 may discharge the printing medium used for cleaning to a location different from the printing medium used for other than cleaning. Therefore, a plurality of paper discharge trays are required. For example, the image forming apparatus 1 may include a plurality of paper discharge trays. Alternatively, the plurality of paper discharge trays may be used by attaching an optional device including the paper discharge trays to the image forming apparatus 1. By doing as described above, the printing medium used for cleaning is not mixed with the printing medium used for other than cleaning.

The image forming apparatus 1 may print an image or the like that is known to be used for cleaning on the printing medium used for cleaning. By doing as described above, it becomes easier to distinguish the printing medium used for cleaning.

The image forming apparatus 1 may be capable of performing an operation of decolorizing a decolorable recording material. In this case, the processor 11 sets the temperature of the heat roller 1081 to a temperature for decoloring recording material. The temperature is a temperature higher than the fixing temperature and is, for example, 180° C. The processor 11 feeds the printing medium on which an image is recorded with the decolorable recording material from the paper feeding cassette 101. The printing medium is passed through the fixing unit 108 so that recording material is decolorized. In the above-described operation, the temperature of the heat roller 1081 is a temperature higher than the fixing temperature. Therefore, similar to when the cleaning operation is performed, the adhering matter may be removed in the operation. Therefore, when performing the decoloring operation, the processor 11 may reduce the value of the label counter depending on an amount for performing the decoloring operation. By doing as described above, the image forming apparatus 1 can prevent the cleaning operation from being performed when the adhering matter is unlikely to be adhered.

The amount for increasing the value of the printing counter is not limited to one. In addition, the amount for increasing the value of the printing counter is not limited to an integer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a transport unit configured to transport a printing medium;

an input unit configured to input the printing medium transported by the transport unit as a first printing medium having an adhering matter;

a printing unit configured to form an image on the printing medium;

a fixing unit configured to heat and press the printing medium at a fixing temperature to fix the image; and a control unit configured as:

a first counter configured to count a first number of sheets of the first printing medium transported by the transport unit, a second counter configured to count a second number of sheets of the printing medium including the first printing medium transported by the transport unit, and to execute a cleaning operation when a first value of a counter is more than a threshold value set in advance, wherein in the cleaning operation, the second counter is not increased, and the printing unit is stopped, and a second printing medium, other than the first printing medium, that is transported by the transport unit is passed through the fixing unit.

2. The apparatus according to claim 1, wherein the cleaning operation includes an operation of controlling a temperature of the fixing unit to a cleaning temperature higher than the fixing temperature.

3. The apparatus according to claim 1, wherein the cleaning operation includes an operation of changing a pressing force against the second printing medium by the fixing unit.

4. The apparatus according to claim 1, wherein the cleaning operation includes an operation of changing a speed at which the second printing medium is passed through the fixing unit.

5. The apparatus according to claim 1, further comprising:

a double-sided unit configured to reverse the second printing medium, wherein the cleaning operation includes an operation of reversing front and back sides of the second printing medium having been passed through the fixing unit by the double-sided unit and then causing the second printing medium to be passed through the fixing unit again.

6. The apparatus according to claim 1, wherein the first printing medium is a label sheet.

7. The apparatus according to claim 1, wherein the control unit determines an increase amount of a usage amount of the first printing medium based on a type of the first printing medium.

8. The apparatus according to claim 1, wherein the transport unit transports the first printing medium or the second printing medium from a manual feeding tray.

9. A cleaning method comprising:

performing a printing operation on a first printing medium of a set of printing medium, the first printing medium having an adhering matter; counting a first number of sheets of the first printing medium being transported;

counting a second number of sheets of the set of printing medium including the first printing medium being transported; and performing a cleaning operation on a second printing medium other than the first printing medium based on a usage amount of the first printing medium, wherein in the printing operation, the first printing medium is transported, an image is formed on the first printing medium, and the first printing medium is heated by a fixing unit, and wherein in the cleaning operation, the second printing medium is transported and passed through the fixing unit, and wherein the counting the second number of sheets of the set of printing medium is not performed during the cleaning operation.

* * * * *